US005615722A

United States Patent [19]

Garrett et al.

[11] Patent Number: 5,615,722

[45] Date of Patent: Apr. 1, 1997

[54] VALANCE SHAPED ENHANCEMENT APPARATUS

[76] Inventors: Julie Garrett; Thomas Ashlock, both of 2209 Shannawood Dr., Lexington, Ky. 40513

[21] Appl. No.: 548,963

[22] Filed: Oct. 27, 1995

[51] Int. Cl.[6] ..... E04F 10/00

[52] U.S. Cl. ..... 160/38; 160/330

[58] Field of Search ..... 160/38, 39, 19, 160/123, 124, 127, 237, 90, 108, 349.1, 349.2, 330, 84.05; 52/2.11, 2.13, 2.17, 2.19, 2.22, 2.23, 2.24

[56] References Cited

U.S. PATENT DOCUMENTS

| | | | |
|---|---|---|---|
| D. 283,284 | 4/1986 | Sather, Jr. . | |
| D. 334,683 | 4/1993 | Byrne . | |
| 2,028,060 | 1/1936 | Gilbert | 52/2.19 X |
| 2,191,374 | 2/1940 | Dixon | 52/2.19 X |
| 3,807,100 | 4/1974 | Kuss | 52/2.11 |
| 3,918,512 | 11/1975 | Kuneman | 160/90 |
| 4,040,210 | 7/1977 | Land | 160/90 X |
| 4,098,035 | 7/1978 | Bessler | 52/2.12 |
| 4,246,951 | 1/1981 | Givens . | |
| 4,255,907 | 3/1981 | Lightell | 160/90 X |
| 4,255,908 | 3/1981 | Rosenberg | 52/2.12 |
| 4,346,132 | 8/1982 | Cheng et al. | 52/2.12 |
| 4,770,224 | 9/1988 | Dubbelman | 160/349.1 X |
| 4,865,105 | 9/1989 | Peters . | |
| 5,062,463 | 11/1991 | Peters . | |
| 5,159,965 | 11/1992 | Roy et al. . | |

*Primary Examiner*—David M. Purol

[57] ABSTRACT

A valance shape enhancement apparatus includes a flexible valance which has a longitudinal valance length. An inflatable valance shape enhancement assembly is provided which is substantially coextensive with the flexible valance along the longitudinal valance length. The flexible valance may be formed from a quantity of flexible material has two edges that are juxtaposed and is connected together, such that the flexible valance includes a longitudinally shaped pocket. The inflatable valance shape enhancement assembly is received in the longitudinally shaped pocket of the flexible valance. The inflatable valance shape enhancement assembly includes an inflatable body portion and a valve assembly is connected to the inflatable body portion. Preferably, the inflatable body portion is made of transparent material. In addition, the inflatable body portion may be made from elastic material. The valve assembly includes a valve stem portion is connected to the inflatable body portion, and a valve plug portion is connected to the valve stem portion. In a second embodiment of the inflatable valance shape enhancement assembly. A quantity of ballast material is contained within the inflatable valance shape enhancement assembly. In addition, a method for enhancing the shape of a flexible valance includes the step of inserting an inflatable object behind a front portion of the valance.

1 Claim, 2 Drawing Sheets

FIG 3
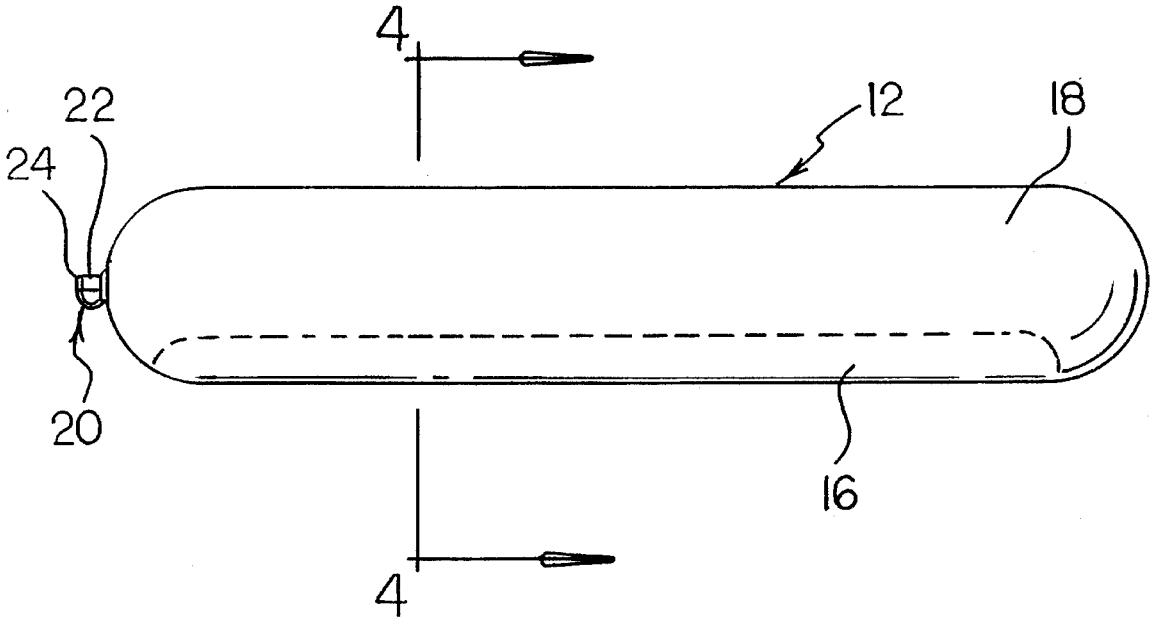
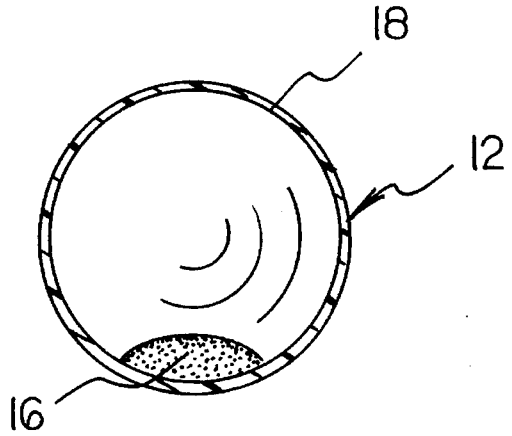
FIG 4

VALANCE SHAPED ENHANCEMENT APPARATUS

BACKGROUND OF THE INVENTION

1. Field of the Invention

The present invention relates generally to valances and, more particularly, to a device especially adapted for enhancing the shape of a valance.

2. Description of the Prior Art

A valance is a short decorative drapery that extends across the top of a window or the like. Without some form of special support, valances often hang limply. However, for many persons a limply hanging valance is undesirable. A common way to enhance the shape of a valance so that it does not hang limply is to stuff the valance crumpled paper and the like. Another of disadvantages result when valances are stuffed with crumpled paper. For example, it is very difficult to stuff the valance evenly and consistently throughout the full length of the valance. As a result, the valance may bulge in certain places and recede in other places. In this respect, it would be desirable if a device were provided that enhanced the shape of a valance evenly throughout the length of the valance.

Another disadvantage in using crumpled paper to enhance the shape of a valance relates to the action of sunlight on the stuffed valance. When sunlight streams into a room through a window, the sunlight generally penetrates through the valance. As a result, any crumpled paper that is present in the valance can be visible in the room. Such an appearance is unesthetic and undesirable. In this respect, it would be desirable if a device were provided that enhanced the shape of a valance without providing an unesthetic appearance in sunlight due to crumpled paper.

Still another disadvantage of using crumpled paper to enhance the shape of a valance relates to the fact that different portions of crumpled paper may collapse at different rates. The result of this effect is that an evenly shape-enhanced valance may lose its evenness of shape over time. In this respect, it would be desirable if a device were provided that enhanced the shape of a valance that did not lose its evenness of shape over time.

A room often has more than one valance. For purposes of beauty and appearance, it would be desirable if each valance in a room were shaped in a similar way. Using crumpled paper to enhance the shape of a plurality of valances in one room in a similar way is an objective that is very difficult to achieve. In this respect, it would be desirable if a device were provided that easily provides for enhancement of the shape of a plurality of valances in a room in a similar way.

Throughout the years, a number of innovations have been developed relating to valances or other devices associated with decorating windows, and the following U.S. patents are representative of some of those innovations: U.S. Pat. Nos. 4,246,951; 4,865,105; 5,062,463; 5,159,965; U.S. Pat. No. Des. 283,284; and U.S. Pat. No. Des. 334,683. More specifically, each of U.S. Pat. Nos. 4,246,951, 5,159,965, and U.S. Pat. No. Des. 334,683 discloses a rigid valance whose shape is unchangeable. For purposes of given an individual latitude in decorating one's home, such latitude may involve the personalized adjustment of the shape of a valance. Such personalized adjustment cannot be obtained with a rigid valance whose shape is unchangeable. In this respect, it would be desirable if a device were provided that can be used to selectively enhance the shape of a flexible valance.

Each of U.S. Pat. Nos. 4,865,105 and 5,062,463 discloses a rigid framework that is inserted behind valance-like decorative devices for windows. As discussed above, rigid devices do not permit a person to vary the shape of a valance as desired. Moreover, the rigid frameworks require mechanical connectors to connect the frameworks to a window frame. To avoid such complexities, it would be desirable if a device were provided that enhanced the shape of a valance requiring mechanical connection of the shape-enhancing device to a window frame. U.S. Pat. No. Des. 283,284 may be of interest for its disclosure of an ornamental design of a lambrequin.

Still another feature would be desirable in a valance shape enhancement apparatus. It may be desirable to enhance the shape of the valance in two distinct ways. One way is to puff the valance out in a horizontal direction. Another way is to gently pull the valance down in a vertical direction. In this respect, it would be desirable if a device were provided that enhanced the shape of a valance by both puffing the valance out in a horizontal direction and pulling the valance down in a vertical direction.

Thus, while the foregoing body of prior art indicates it to be well known to use valance shaping devices, the prior art described above does not teach or suggest a valance shape enhancement apparatus which has the following combination of desirable features: (1) enhances the form of a valance evenly throughout the length of the valance; (2) avoids an unesthetic appearance in sunlight due to crumpled paper; (3) enhances the shape of a valance in a manner so that the valance does not lose its evenness of shape over time; (4) easily provides for similar enhancement of the shapes of a plurality of valances; (5) can be used to selectively and adjustably enhance the shape of a flexible valance; (6) enhances the shape of a valance without requiring mechanical connection of a shape-enhancing device to a window frame; and (7) enhances the shape of a valance by both puffing the valance out in a horizontal direction and pulling the valance down in a vertical direction. The foregoing desired characteristics are provided by the unique valance shape enhancement apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a valance shape enhancement apparatus which includes a flexible valance which has a longitudinal valance length. An inflatable valance shape enhancement assembly is provided which is substantially coextensive with the flexible valance along the longitudinal valance length. The flexible valance may be formed from a quantity of flexible material having two edges that are juxtaposed and is connected together, such that the flexible valance includes a longitudinally shaped pocket. The inflatable valance shape enhancement assembly is received in the longitudinally shaped pocket of the flexible valance. The inflatable valance shape enhancement assembly includes an inflatable body portion and a valve assembly connected to the inflatable body portion. Preferably, the inflatable body portion is made of transparent material. In addition, the inflatable body portion may be made from elastic material.

The valve assembly includes a valve stem portion connected to the inflatable body portion, and a valve plug portion is connected to the valve stem portion.

In a second embodiment of the inflatable valance shape enhancement assembly, a quantity of ballast material is contained within the inflatable valance shape enhancement assembly.

In accordance with yet another aspect of the invention, a method is provided for enhancing the shape of a flexible valance. The method includes the step of inserting an inflatable object behind a front portion of the valance.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved valance shape enhancement apparatus which has all of the advantages of the prior art and none of the disadvantages.

It is another object of the present invention to provide a new and improved valance shape enhancement apparatus which may be easily and efficiently manufactured and marketed.

It is a further object of the present invention to provide a new and improved valance shape enhancement apparatus which is of durable and reliable construction.

An even further object of the present invention is to provide a new and improved valance shape enhancement apparatus which is susceptible of a low cost of manufacture with regard to both materials and labor, and which accordingly is then susceptible of low prices of sale to the consuming public, thereby making such valance shape enhancement apparatus available to the buying public.

Still yet a further object of the present invention is to provide a new and improved valance shape enhancement apparatus which enhances the form of a valance evenly throughout the length of the valance.

Still another object of the present invention is to provide a new and improved valance shape enhancement apparatus that avoids an unesthetic appearance in sunlight due to crumpled paper.

Yet another object of the present invention is to provide a new and improved valance shape enhancement apparatus which enhances the shape of a valance in a manner so that the valance does not lose its evenness of shape over time.

Even another object of the present invention is to provide a new and improved valance shape enhancement apparatus that easily provides for similar enhancement of the shapes of a plurality of valances.

Still a further object of the present invention is to provide a new and improved valance shape enhancement apparatus which can be used to selectively and adjustably enhance the shape of a flexible valance.

Yet another object of the present invention is to provide a new and improved valance shape enhancement apparatus that enhances the shape of a valance without requiring mechanical connection of a shape-enhancing device to a window frame.

Still another object of the present invention is to provide a new and improved valance shape enhancement apparatus which enhances the shape of a valance by both puffing the valance out in a horizontal direction and pulling the valance down in a vertical direction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a side view of a second embodiment of an inflatable valance shape enhancement assembly of the invention which contains a quantity of ballast material.

FIG. 4 is a cross-sectional view of a second embodiment of the invention shown in FIG. 3 taken along line 4—4 thereof.

DESCRIPTION OF THE PREFERRED EMBODIMENT

With reference to the drawings, a new and improved valance shape enhancement apparatus embodying the principles and concepts of the present invention will be described.

Figure 1:
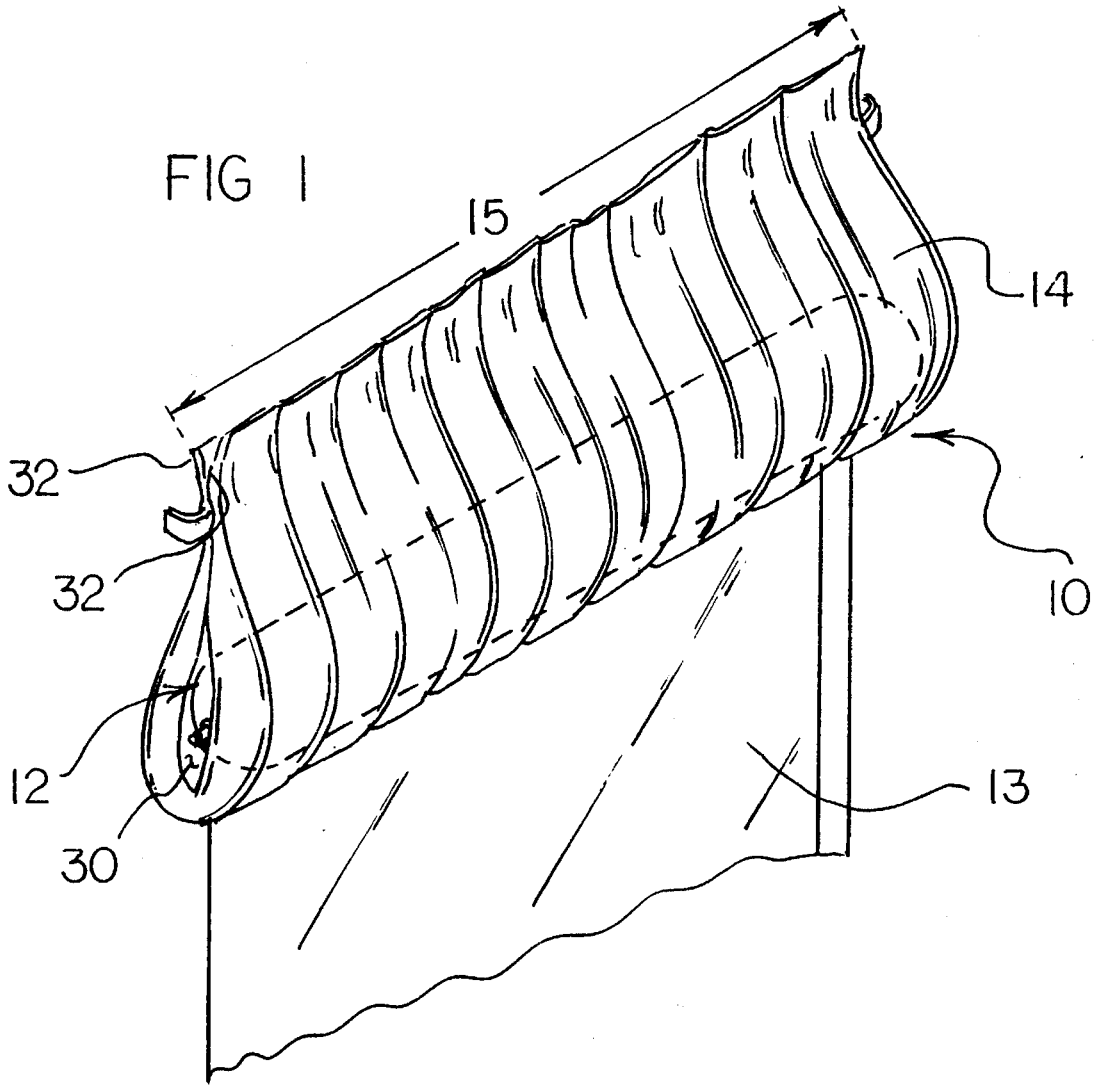
FIG. 1 is a perspective view showing a first embodiment of an inflatable valance shape enhancement assembly of the invention in use in a flexible valance over a window.
Figure 2:
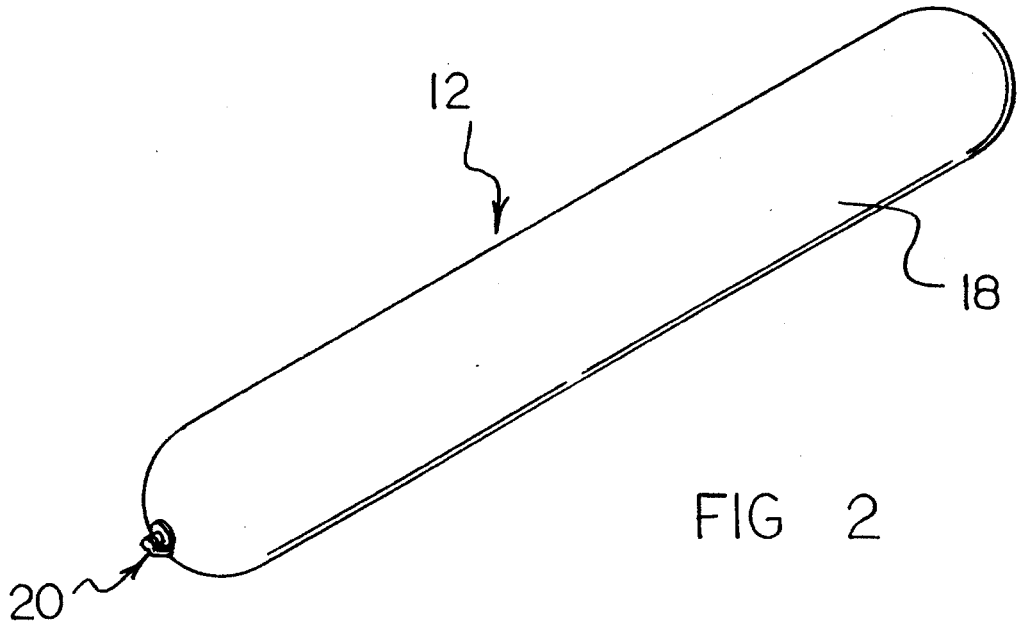
FIG. 2 is a perspective view of the first embodiment of the inflatable valance shape enhancement assembly of FIG. 1 removed from the flexible valance.

Turning to FIGS. 1–2, an embodiment of the valance shape enhancement apparatus 10 is shown which contains a first embodiment of a inflatable valance shape enhancement assembly 12. More specifically, the valance shape enhancement apparatus 10 includes a flexible valance 14 which has a longitudinal valance length 15. An inflatable valance shape enhancement assembly 12 is provided which is substantially coextensive with the flexible valance 14 along the longitudinal valance length 15. The flexible valance 14 may be formed from a quantity of flexible material having two edges 32 that are juxtaposed and is connected together, such that the flexible valance 14 includes a longitudinally shaped pocket 30. The edges 32 can be sewn together to form the longitudinally shaped pocket 30. The inflatable valance shape enhancement assembly 12 is received in the longitudinally shaped pocket 30 of the flexible valance 14. The inflatable valance shape enhancement assembly 12 includes an inflatable body portion 18 and a valve assembly 20 connected to the inflatable body portion 18. Preferably, the inflatable body portion 18 is made of transparent material. In addition, the inflatable body portion 18 may be made from elastic material.

The valve assembly 20 includes a valve stem portion 22 connected to the inflatable body portion 18, and a valve plug portion 24 is connected to the valve stem portion 22.

Turning to FIGS. 3 and 4, a second embodiment of the invention is shown. Reference numerals are shown that correspond to like reference numerals that designate like elements shown in the other figures. In addition, a quantity of ballast material 16 is contained within the inflatable valance shape enhancement assembly 12.

In using either the first or the second embodiment of the inflatable valance shape enhancement assembly 12 of the invention, the flexible valance 14 is in place over a window 13 or the like. An inflatable valance shape enhancement assembly 12 is inflated by removing the valve plug portion 24 from the valve stem portion 22 and by forcing air into the inflatable body portion 18. One can simply blow on the valve stem portion 22 to inflate the inflatable body portion 18 to a desired degree of inflation. Then the valve plug portion 24 is caused to plug up the valve stem portion 22 to retain air in the inflatable body portion 18. The inflated inflatable valance shape enhancement assembly 12 is then inserted into the longitudinally shaped pocket 30 of the flexible valance 14. In this way, the inflatable valance shape enhancement assembly 12 is located behind the front portion (the portion facing the interior of the room) of the flexible valance 14.

More inflation of the inflatable valance shape enhancement assembly 12 will cause the shape of the flexible valance 14 to be enhanced more. Less inflation will cause the shape of the flexible valance 14 to be enhanced less. Equal inflation of a plurality of inflatable valance shape enhancement assemblies 12 for different flexible valances 14 will cause the plurality of different valances 14 to shaped equally.

The use of the ballast material 16 in the second embodiment of the inflatable valance shape enhancement assembly 12 provides a substantial downward force of gravity on the inflatable valance shape enhancement assembly 12 in the flexible valance 14 causing the inflatable valance shape enhancement assembly 12 to exert a substantial vertical shaping force. More ballast material 16 will cause a greater downward valance-shaping force. Less ballast material 16 will cause a lesser downward valance-shaping force. A convenient ballast material 16 is sand, although other ballast materials can be employed.

The inflatable valance shape enhancement assembly 12 can be made in a variety of ways. In one way, two flat sheets of plastic are placed one on top of the other, and the edges of the plastics sheets are heat sealed together. In this way. An inflatable body portion 18 is formed. A valve assembly 20 is placed and attached to one end of the inflatable body portion 18. The plastic sheets can be either elastic or inelastic as long as they retain pressurized air. Alternatively, two sheets of flexible rubber can be placed one on top of the other, and the edges can be bonded together to form an inflatable body portion 18. Then a valve assembly 20 is connected to the inflatable body portion 18. Still alternatively, a relatively long and thin rubber balloon can be employed for the inflatable valance shape enhancement assembly 12 of the invention. Actually, a relatively long and thin rubber balloon is shown in the drawings. Preferably, the inflatable body portion 18 of the inflatable valance shape enhancement assembly 12 is made from transparent, elastic material. As a result, when sun shines through a flexible valance 14 containing a transparent inflatable valance shape enhancement assembly 12, the inflatable valance shape enhancement assembly 12 is not made very noticeable by the sunlight.

The components of the valance shape enhancement apparatus of the invention can be made from inexpensive and durable plastic, rubber, and cloth materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved valance shape enhancement apparatus that is low in cost, relatively simple in design and operation, and which may advantageously be used to enhance the form of a valance evenly throughout the length of the valance. With the invention, a valance shape enhancement apparatus is provided which avoids an unesthetic appearance in sunlight due to crumpled paper. With the invention, a valance shape enhancement apparatus is provided which enhances the shape of a valance in a manner so that the valance does not lose its evenness of shape over time. With the invention, a valance shape enhancement apparatus is provided which easily provides for similar enhancement of the shapes of a plurality of valances. With the invention, a valance shape enhancement apparatus is provided which can be used to selectively and adjustably enhance the shape of a flexible valance. With the invention, a valance shape enhancement apparatus is provided which enhances the shape of a valance without requiring mechanical connection of a shape-enhancing device to a window frame. With the invention, a valance shape enhancement apparatus is provided which enhances the shape of a valance by both puffing the valance out in a horizontal direction and pulling the valance down in a vertical direction.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A valance shape enhancement apparatus suitable for placement near the upper portion of a window so as to cover at least a portion of the window, said apparatus comprising:

a flexible valance having a longitudinal valance length, and an inflatable valance shape enhancement assembly, substantially coextensive with said flexible valance along said longitudinal valance length, wherein said flexible valance is formed from a quantity of flexible material having two edges that are juxtaposed and connected together, such that said flexible valance includes a longitudinally shaped pocket extending downward from said top portion of said window such that said quantity of flexible material and said pocket covers a longitudinal expanse of said window, wherein said inflatable valance shape enhancement assembly is received in said longitudinally shaped pocket of said flexible valance, wherein said inflatable valence shape enhancement assembly is of light transmissive material such that said assembly is not visible in said pocket when light shines through said longitudinal expanse of window covered by said valence and coextensive with said pocket therein, wherein said inflatable valance shape enhancement assembly includes:

an inflatable body portion, and a valve assembly connected to said inflatable body portion, and wherein said apparatus further includes a quantity of ballast material contained within said inflatable body portion to provide a downward shaping force to said flexible valence and wherein said quantity of ballast material comprises sand.

* * * * *